US011799243B2

(12) United States Patent
Wronowski et al.

(10) Patent No.: US 11,799,243 B2
(45) **Date of Patent: *Oct. 24, 2023**

(54) ELECTRICAL CONNECTOR ASSEMBLY WITH RF IMPEDANCE ELEMENT

(71) Applicant: Carlisle Interconnect Technologies, Inc., St. Augustine, FL (US)

(72) Inventors: Sage A. Wronowski, Boyertown, PA (US); Ralph D. Schafer, Douglassville, PA (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/818,211

(22) Filed: Aug. 8, 2022

(65) Prior Publication Data

US 2022/0384997 A1 Dec. 1, 2022

Related U.S. Application Data

(63) Continuation of application No. 17/318,620, filed on May 12, 2021, now Pat. No. 11,411,349.

(51) Int. Cl.

| | |
|---|---|
| ***H01R 13/66*** | (2006.01) |
| ***H01R 13/6461*** | (2011.01) |
| ***H01R 13/6584*** | (2011.01) |
| ***H01R 24/54*** | (2011.01) |

(52) U.S. Cl.

CPC ..... *H01R 13/6461* (2013.01); *H01R 13/6584* (2013.01); *H01R 24/545* (2013.01)

(58) Field of Classification Search

CPC ..... H01R 13/719; H01R 13/6658; H01R 13/187; H01R 23/727; H01R 13/20; H01R 13/15

See application file for complete search history.

(56) References Cited

U.S. PATENT DOCUMENTS

| | | | | |
|---|---|---|---|---|
| 3,581,609 | A | 6/1971 | Greenwood | |
| 8,403,611 | B2 * | 3/2013 | Friesen | F16B 39/32 411/533 |
| 9,909,446 | B2 | 3/2018 | Bynum | |
| 10,234,064 | B2 | 3/2019 | Patel et al. | |
| 11,264,752 | B1 | 3/2022 | Durse et al. | |

(Continued)

*Primary Examiner* — Phuong Chi Thi Nguyen

(74) *Attorney, Agent, or Firm* — Wood Herron & Evans LLP

(57) ABSTRACT

A connector and shielding ring for use with the connector includes a male portion with a shroud and a center conductor and a female portion with a jack and a socket positioned to receive the center conductor. A conductive shielding ring is positioned between the mated connector portions. The shielding ring has a body configured for surrounding flexible tines of the female portion jack and is configured to be captured between the tines and the shroud for providing a grounding path between the male and female portions of the connector. The shielding ring body has an inner surface with a diameter and an outer surface with a diameter and has a taper portion formed on a distal end of the shielding ring body for engaging a surface of the shroud. The shielding ring body has a lip extending radially inwardly at the proximal end for engaging the tines of the female portion when the male and female portions of the connector are mated.

20 Claims, 7 Drawing Sheets

(56) References Cited

U.S. PATENT DOCUMENTS

| | | | | |
|---|---|---|---|---|
| 11,411,349 | B1 * | 8/2022 | Wronowski | H01R 24/44 |
| 2012/0045452 | A1 | 2/2012 | Steuernagel et al. | |
| 2012/0301248 | A1 | 11/2012 | Arnold et al. | |
| 2013/0149031 | A1 | 6/2013 | Changsrivong et al. | |
| 2022/0059964 | A1 * | 2/2022 | Ando | H01R 4/70 |
| 2022/0059976 | A1 * | 2/2022 | Chen | H01R 13/6598 |
| 2022/0085532 | A1 * | 3/2022 | Costello | H01R 13/659 |

* cited by examiner

ELECTRICAL CONNECTOR ASSEMBLY WITH RF IMPEDANCE ELEMENT

CROSS-REFERENCE TO RELATED APPLICATIONS

This application is a Continuation of U.S. patent application Ser. No. 17/318,620 filed May 12, 2021 (pending), the disclosure of which is incorporated by reference herein.

TECHNICAL FIELD OF THE INVENTION

This invention relates generally to the field of connectors, and specifically to coaxial electrical connectors. The invention relates to the RF shielding performance of SMP or similar coaxial connectors, and the prevention of rocking of the female connector relative to the male when mated.

BACKGROUND OF THE INVENTION

Generally, snap-in or push-on style coaxial connectors, such as SMP connectors, have historically encountered RF shielding performance issues when compared to equivalent threaded coaxial connectors. Such push-on connectors usually incorporate flexible tines or fingers along the length of the female portion of the connector. The flexible tines are formed by slots that are fabricated along the length of the female connector body to facilitate the free flexing of the tine members so they may be displaced during coupling (snap-in). Such conditions and RF shielding issues exist for various styles of snap-in or push-on connectors, including but are not limited to SMP, SMPM, WMP, GPO, GPPO, G4PO, #12, #14, and #8 connectors and contacts.

Push-on or snap-in style coaxial connectors also may present the risk of axial misalignment, such as in high density applications, where they are employed in ganged configurations that have specific pitch tolerances. Such axial misalignment can cause damage to the connector, leading to a degradation of signal performance. Misalignment also causes a mis-mated condition where the EMI shield of the connector does not function as intended.

To address shielding issues, electromagnetic interference (EMI) ring elements have been designed for snap-in connectors and are used to improve RF shielding performance and also to assure axial alignment. Such a function may be accomplished with one or multiple ring elements. Normally, existing ring elements have an inner diameter that hugs the outer diameter of the tines of the female connector body. Usually there is very little to no gap between the tines and the EMI ring element. This is done to ensure that the slots are covered mechanically and provide support so that the ring element(s) can be used as an anti-rocking ring, as well as an RF shield. While existing ring designs somewhat improve axial alignment and offer some improvement in RF Shielding performance in comparison to no ring at all, there still is a need to meet various industry requirements. This is especially so if a ring element is to be used in a smooth bore detent.

FIGS. 1A, 1B and 1C show an example of a connector 10 utilizing an EMI ring 12 that is representative of an existing ring element in the field. Such a design, when seated and implemented into a push-on style connector as shown in FIG. 1A has a distal outer diameter radius 17 that is reduced and thus may not consistently contact the male shroud 16 of the connector portion 6. Such seating will depend upon the detent of the shroud, such as whether it is a smooth bore, a limited detent, or a full detent. It will also depend on the stack up tolerances between the connector parts. This failure to consistently seat and make contact with the male connector shroud in existing designs causes degradation in the RF shielding performance due to a loss in the grounding path. The degraded shielding may simply be due to the ring not shielding the tines properly due to the mis-mating. Also, while such an existing ring will work to some degree in one or two detent variations, it generally will not work for all three.

Additionally, when the existing ring design as shown in FIG. 1B, is utilized, there is no gap between the female tine 24, and the ID of the EMI ring. This prevents the ring from adjusting appropriately when the various different connector portions are in a mis-mated condition. Also, since there is no gap between the inside diameter of the ring 12 and the outside diameter of the tine 24, there is no potential to create a high impedance section that can reflect and prevent propagating energy from leaving the internal circuit of the connector portions 6, 8 and is therefore susceptible to allowing stray RF signal either into or out of the cable assemblies when considering isolation or RF shielding.

For these applications, an optimized EMI ring designed for push-on connectors is desirable that improves RF shielding performance. It is further desirable to have an EMI ring and connector design that easily passes industry specifications while maintaining an anti-rock feature that maintains its performance, even in a mis-mated condition. Such a design would address a latent performance problem that exists in the industry. Furthermore, an EMI ring that can achieve this improvement regardless of the mating detent would be advantageous and highly desirable over existing art.

SUMMARY OF THE INVENTION

A connector and shielding ring for use with the connector includes a male portion with a shroud and a center conductor and a female portion with a jack having flexible tines and a socket positioned to receive the center conductor. The male portion and female portion are configured for being mated together to provide an electrical connection. A conductive shielding ring is positioned between the mated connector portions. The shielding ring has a body configured for surrounding the flexible tines of the female portion and is configured to be captured between the tines and the shroud for providing a grounding path between the male and female portions of the connector. The shielding ring body has an inner surface with a diameter and an outer surface with a diameter and has a taper portion formed on a distal end of the shielding ring body for engaging a surface of the shroud. The shielding ring body has a lip extending radially inwardly at the proximal end for engaging the tines of the female portion when the male and female portions of the connector are mated.

BRIEF DESCRIPTION OF THE DRAWINGS

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF EMBODIMENTS OF THE INVENTION

Figure 1A:
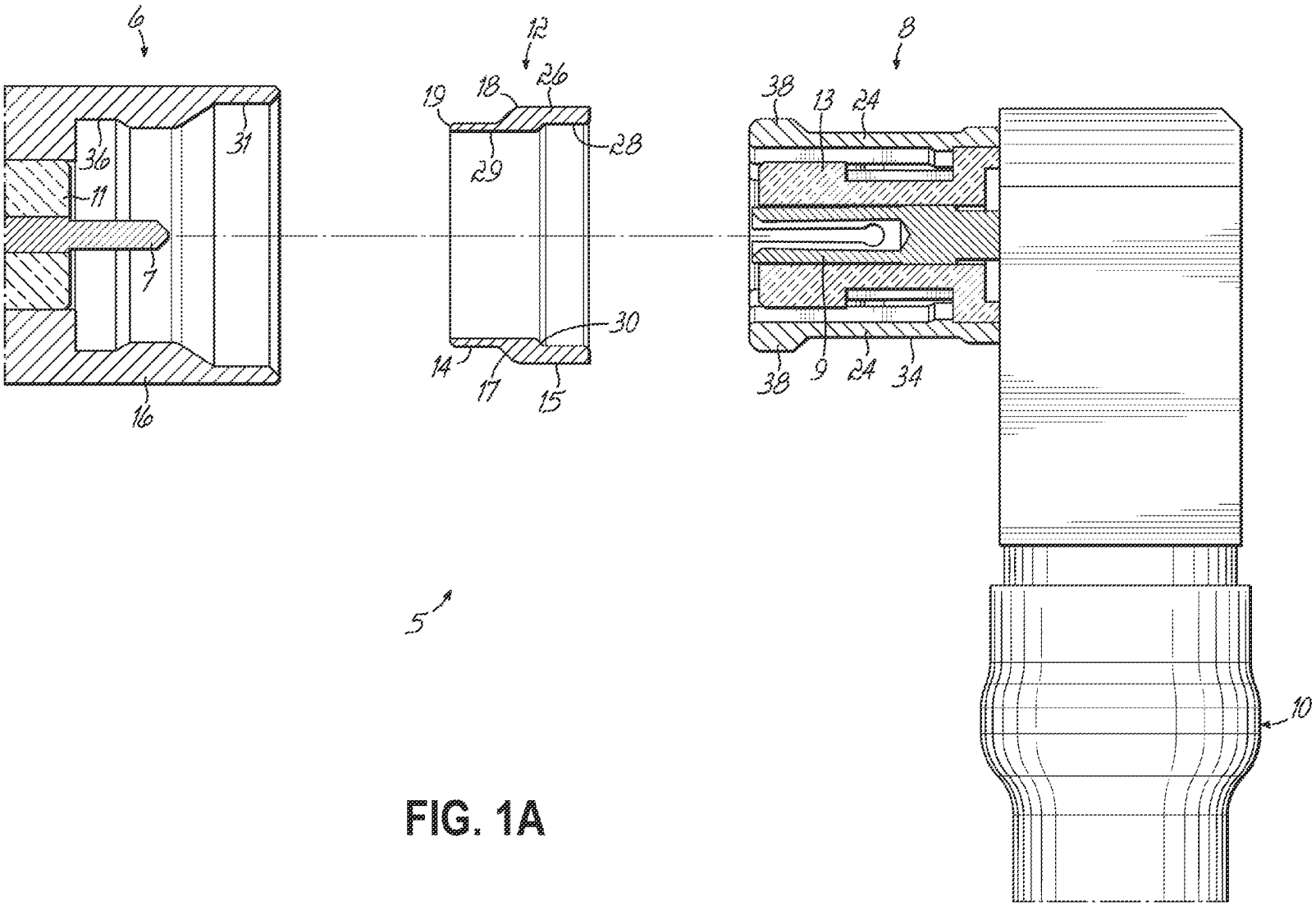
FIG. 1A is an exploded cross-sectional view showing an electrical connector assembly using an existing EMI shielding ring design.
Figure 1B:
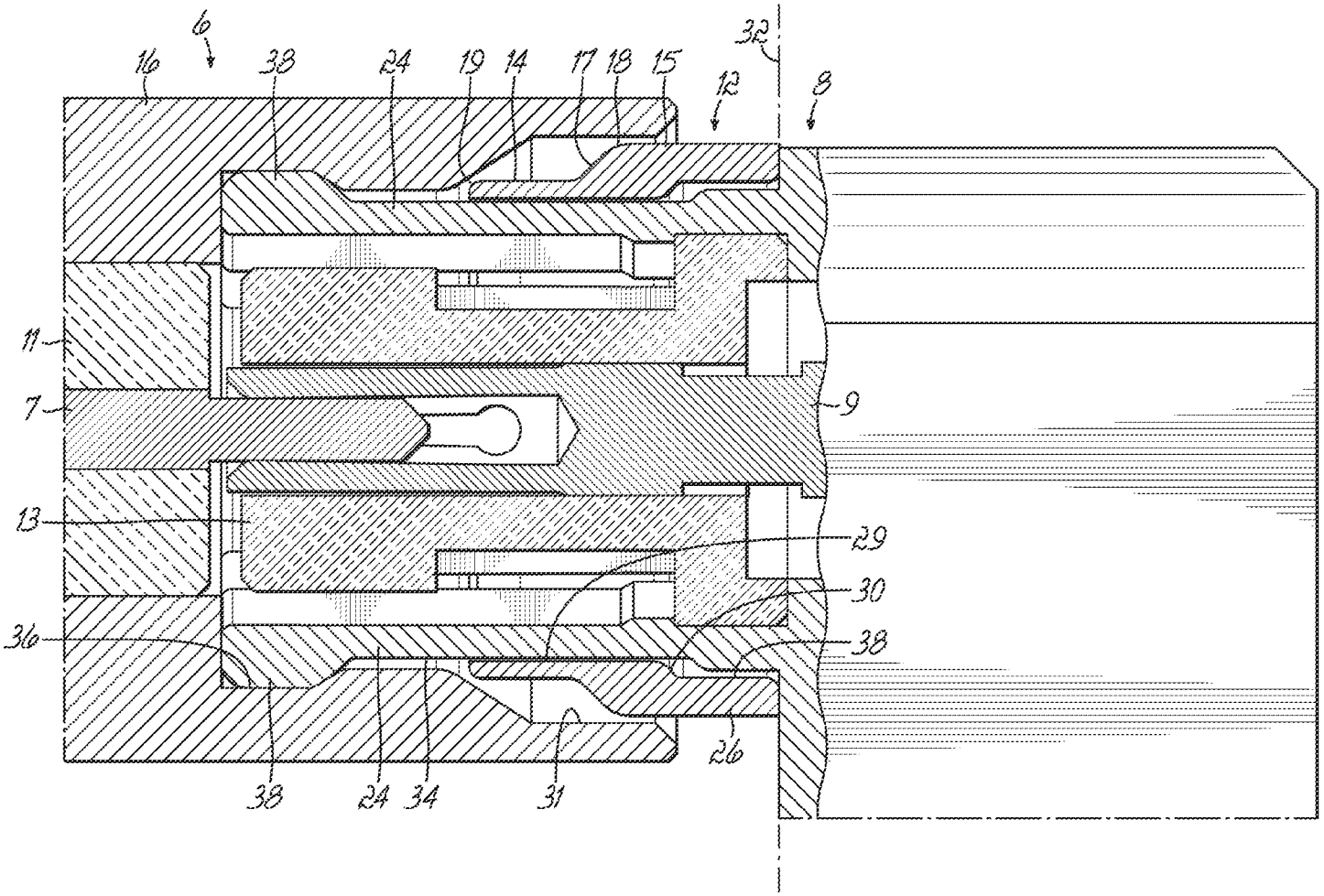
FIG. 1B is a cross-sectional view showing a connected electrical connector assembly using the EMI shielding ring design of FIG. 1A.
Figure 1C:
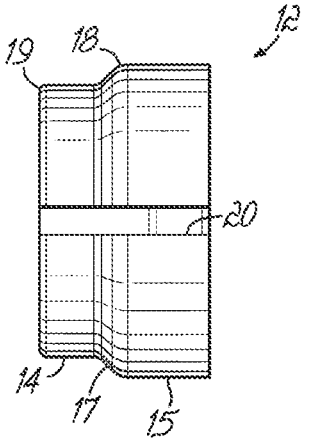
FIG. 1C is a side view of the EMI ring of FIG. 1A.

FIGS. 1A, 1B, and 1C show an example of a push-on or snap-in connector assembly 5 and an EMI ring 12 that is representative of an existing ring element in the field for the purposes of illustration. The connector assembly 5 is representative of a general push-on connector and includes a male portion 6 with a male pin or center conductor 7 and a female portion 8 having a female socket 9 for receiving the pin 7. The female portion 8 is shown coupled to an appropriate cable 10. The male portion 6 could also be coupled with a cable (not shown). The illustrated connector assembly 5 is not limiting and one or both of the male or female portions 6, 8 might be otherwise arranged or mounted, such as on a circuit board. Accordingly, the present invention is not limited to the arrangement of the connector and connector portions in which it is implemented.

In accordance with the push-on style connector assembly, the male and female portions 6, 8 are configured for being pushed together for forming a complete connection wherein the pin 7 is received by the socket 9 and flexible tines 24 of the female portion 8 are received into a male shroud 16 of the male portion 6 as discussed herein. Generally, the pin 7 and socket 9 are surrounded by appropriate insulative elements 11, 13, as shown in FIG. 1A to isolate the center conductor elements of the connector assembly from the outer tines 24 or shroud 16. The tines 24 and shroud 16 form the outer conductor of each connector portion 6, 8. Depending on the type of push-on connector assembly, the shroud 16 might form a detent 36 therein in the socket 31 for receiving flared ends 38 of the flexible tines 24, The ends 38 snap into the detent 36 to seat and secure the two connector portions 6, 8 as shown in FIG. 1B.

The EMI ring 12 has a body that has an outer diameter 15 at the proximal end and a reduced outer diameter 14 at the distal end. A taper or taper portion 17 in the ring tapers down from the proximal end diameter 15 to the distal end diameter 14 through a taper radius 18. A distal end outer diameter radius 19 facilitates insertion into the male shroud 16. The shroud 16 surrounds the pin 7 and forms a socket 31 for receiving the female portion 8 as shown in FIG. 1B. A slot 20 is formed in the solid ring 12 for compression of the ring as seen in FIG. 1C. The ring 12 is captured between the male portion 6 and female portion 8. Specifically, the ring 12 surrounds flexible tines 24 of the female portion 8 of the connector and is inserted with the tines 24 into the socket 31 formed by the male shroud 16 of the male portion 6.

As seen in the cross-section of FIG. 1B, the ring 12 also has a certain cross sectional thickness 26 that tapers from a proximal inner diameter 28 to a smaller distal inner diameter 29 through inner diameter taper 30. Such an existing ring design, when the ring 12 is seated in a seating plane 32 of the connector as shown in FIG. 1B, presents shielding issues. More specifically, the ring 12 at the proximal end may not contact the male shroud 16 when it is seated in the male shroud as shown in FIG. 1B. Such seating of ring 12 will depend upon the detent of the shroud 16, such as whether it is a smooth bore, a limited detent, or a full detent. The seating also depends on the stack up tolerances between the connector parts. This failure of ring 12 to seat and make consistent contact with the male connector shroud 16 causes degradation in the RF shielding performance due to a loss in the grounding path. The degraded shielding aspects may simply not shield the tines 14 as intended due to mis-mating. Also, while such a ring 12 as shown in FIG. 1A may work to some degree in one or two detent connector variations, it will not work in all three variations.

Additionally, with the reduced distal end inner diameter 29 and outer diameter 14 there is very little or no significant gap between the female tines 24, and the inner diameter 29 of the EMI ring 12 as seen in FIG. 1B. This prevents the ring 12 from adjusting appropriately when the connectors 16, 22 are in a mis-mated condition. Also, since there is no gap between the inside diameter 29 of the ring and the outside diameter 34 of the tines 24, there is little potential to create a high impedance feature that can reflect and prevent propagating energy from leaving the internal circuit of the connectors. As such, the existing solution as shown is therefore susceptible to allowing stray RF signals either into or out of the cable assembly when considering isolation or RF shielding.

Figure 3A:
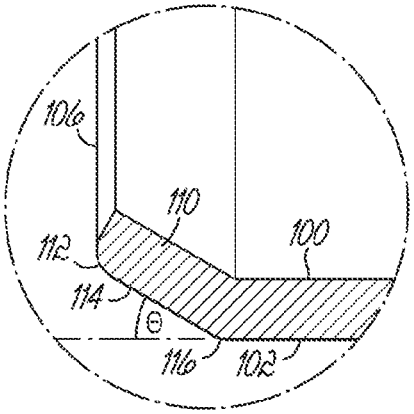
FIG. 3A is an enhanced view at section 3A of FIG. 3 showing a feature of the EMI shielding ring design of FIG. 2A.
Figure 3C:
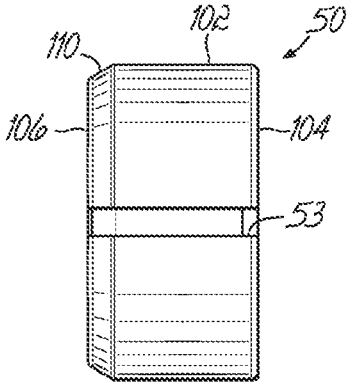
FIG. 3C is a side view of the EMI shielding ring design of FIG. 2A.
Figure 3B:
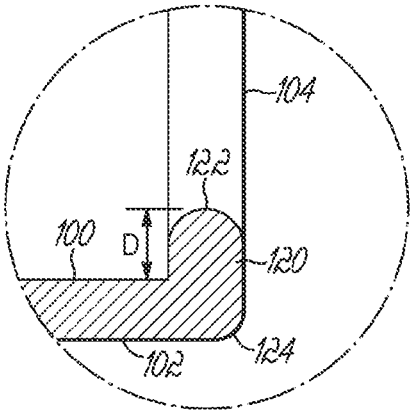
FIG. 3B is an enhanced view at section 3B of FIG. 3 showing a feature of the EMI shielding ring design of FIG. 2A.
Figure 2A:
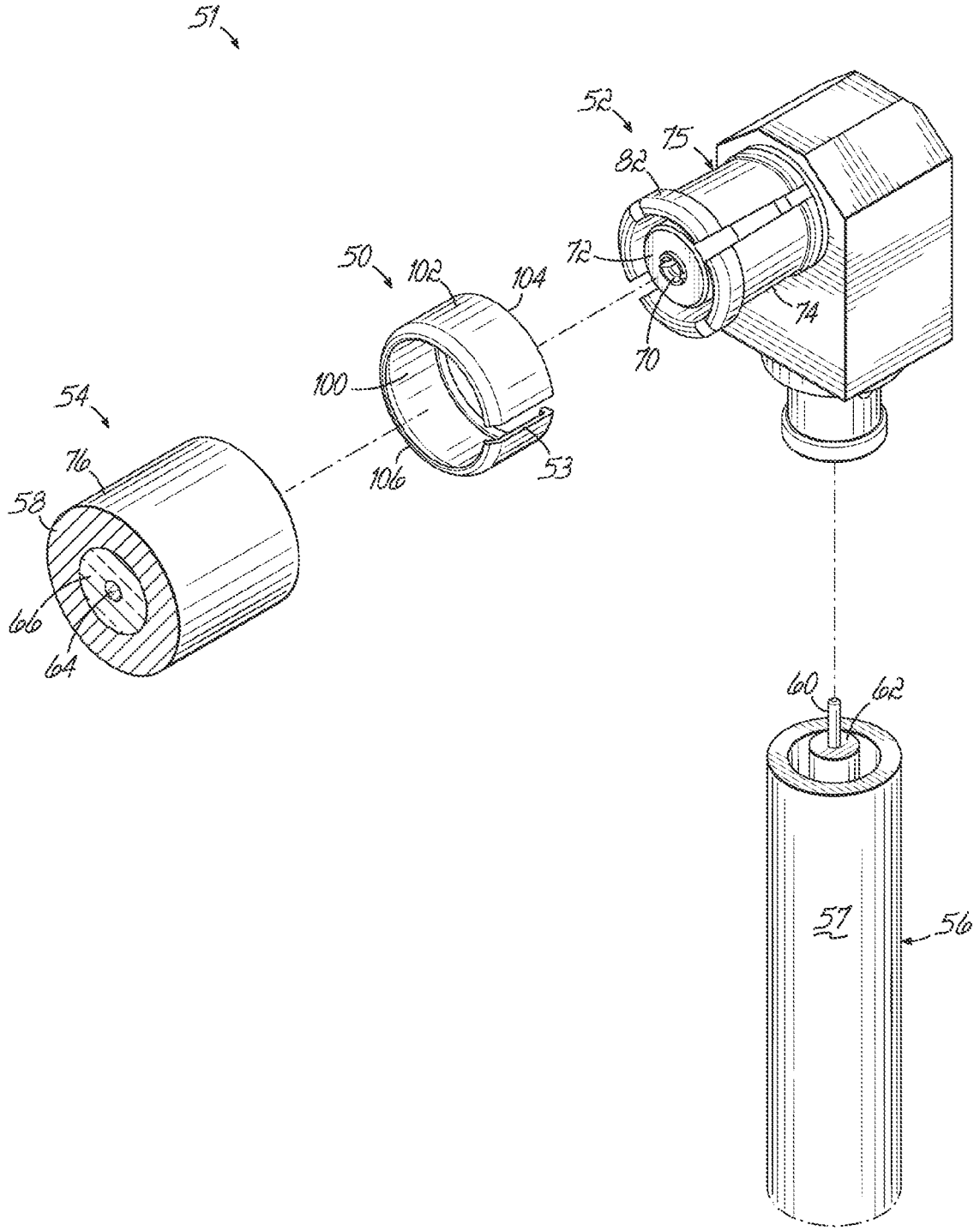
FIG. 2A is an exploded perspective view showing an electrical connector assembly using an EMI shielding ring design in accordance with an embodiment of the present invention.
Figure 2B:
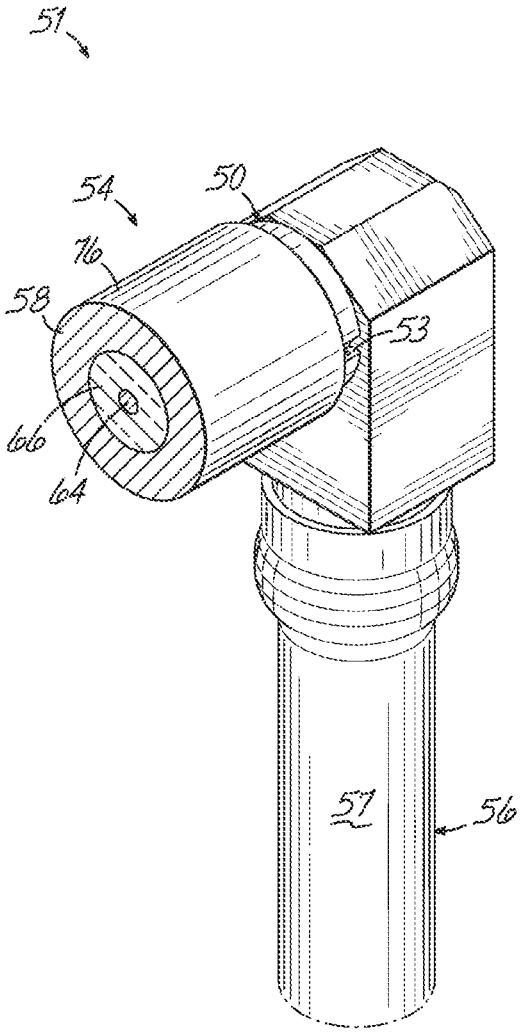
FIG. 2B is a perspective view showing an electrical connector assembly connected together using an EMI shielding ring design in accordance with an embodiment of the present invention.
Figure 3:
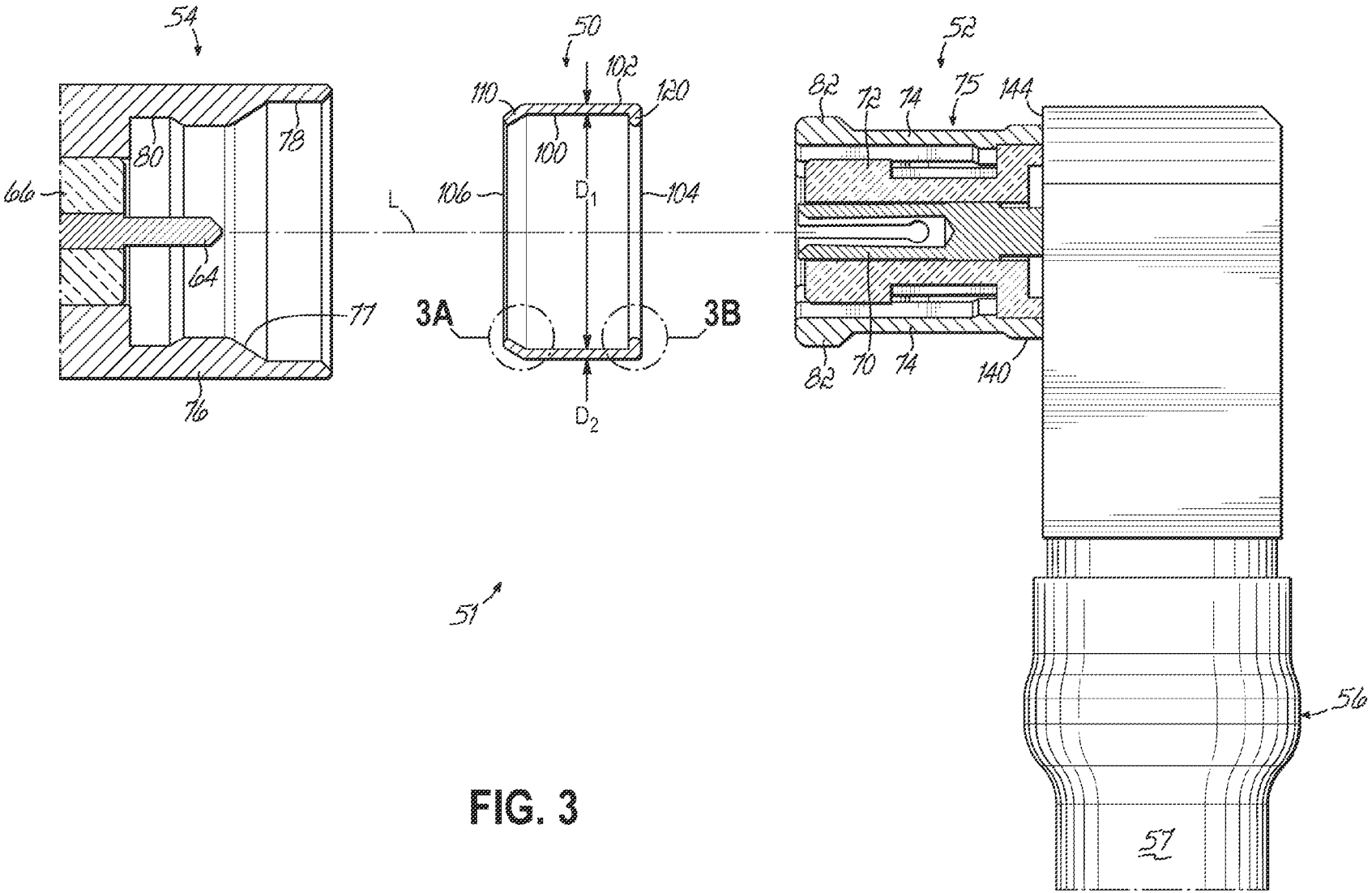
FIG. 3 is a cross-sectional exploded view of an electrical connector assembly using the EMI shielding ring design of FIG. 2A in accordance with the present invention.
Figure 4:
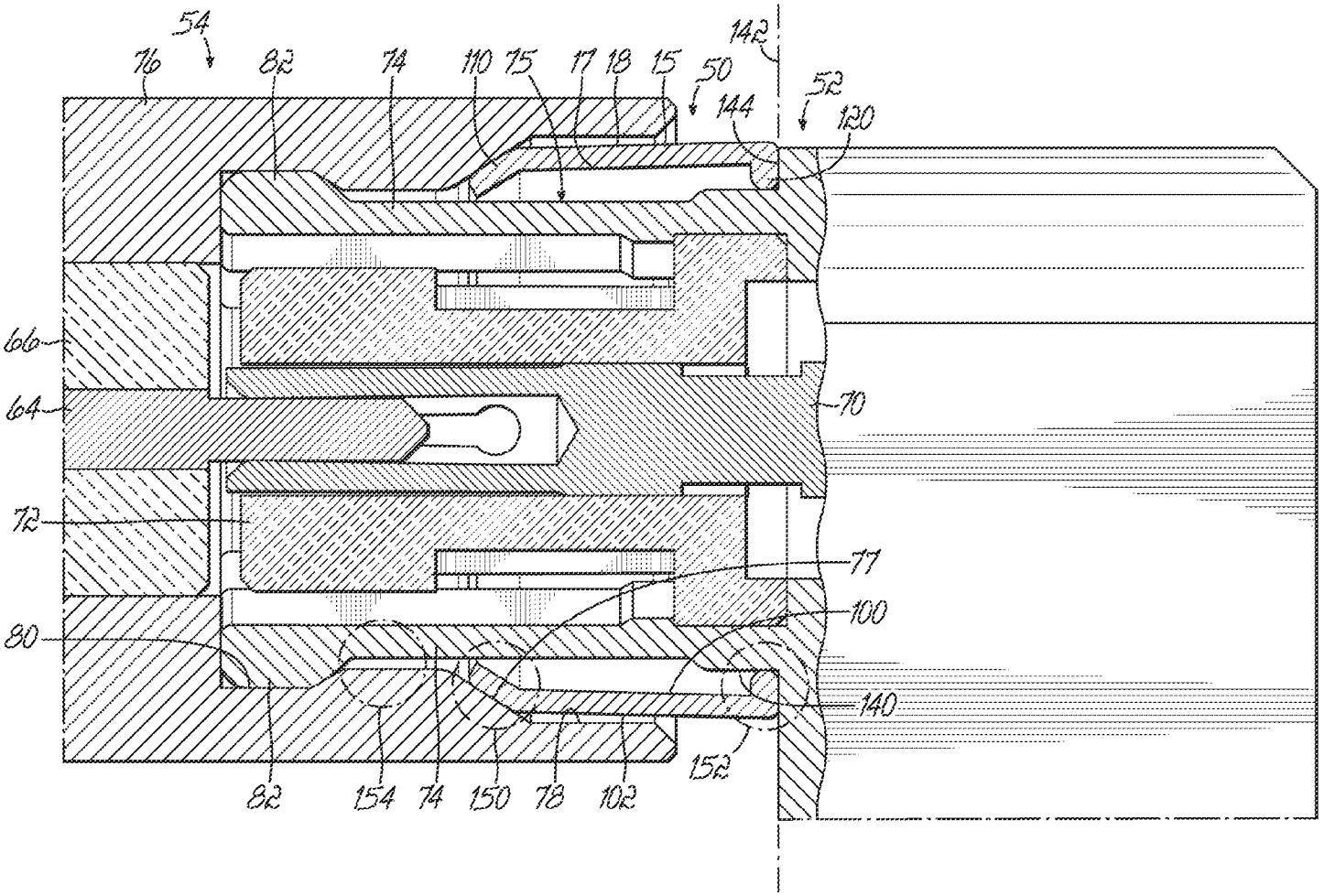
FIG. 4 is a cross-sectional view of a connected electrical connector assembly using an EMI ring design of FIG. 2A in accordance with the present invention.

FIGS. 2-4 illustrate an EMI shielding ring structure in accordance with an embodiment of the invention. The EMI shielding ring structure or ring 50 is composed of Be—Cu or a similar flexible metal or alloy. The ring 50 is then coated with one or more layers (not shown) of gold or a similar high conductivity metal or alloy. The ring 50 addresses various of the drawbacks of the prior art and contacts the body of the female portion of the coaxial connector to limit rocking of the female portion of the connector relative to the male portion. The shielding ring 50 includes a lip that allows better contact and smooth mating/de-mating of the connector assembly 51 and allows for rotation of the connector portions relative to each other when mated.

Referring to FIG. 2A, a push-on connector assembly 51 for utilizing the EMI ring of the invention 50 is illustrated. Specifically, connector assembly 51 incorporates a male portion or body 54 and a female portion or body 52 that can be pushed together or snapped together to create an electrical connection. The two connector portions 52, 54 come together and capture the EMI ring 50 therebetween, as illustrated in FIG. 2B. The female connector portion 52 is illustrated attached to a cable 56, while the male portion 54 is illustrated with an interface 58 that may be coupled with an appropriate signal conductor, including a cable, a printed circuit board, or other signal carrying medium. The different form factors or implementations of each of the male and female portions of the connector, or the type of push-on/snap-in connector utilized for seating the ring 50 is not limiting to the invention, nor is the illustrated embodiment.

Generally, the push-on connector 51, that utilizes the EMI ring 50 of the invention, is a coaxial connector and includes a male portion with an inner or center conductor or pin 64 and an outer conductor in the form of the male shroud 76 that are separated by a suitable insulation layer 66 as shown in FIG. 3. As shown in FIG. 2A, the female portion 52 is coupled to a cable 56 having a center conductor 60 surrounded by insulation 62. The center conductor and insulation along with an outer conductor (not shown) in cable 56 are surrounded by suitable insulation 57 to make up the finished cable. The center conductor 60 of the cable is coupled with a socket 70 of the female portion 52 surrounded by appropriate insulation 72 and the outer conductor of the cable is coupled with the female body of the connector jack 75. The jack 75 includes a plurality of flexible tines 74 as is well known in the art with respect to push-on connector configurations.

Referring to FIG. 3, the male connector portion 54 includes a shroud 76 that forms a socket 78 to contain the pin 64 and insulation 66. As mentioned, the shroud, socket and pin can be implemented into a number of connector form factors and be used, for example, with cables and circuit board connections. The EMI ring 50 of the invention is therefore not limited to a particular push-on connector arrangement as noted. The socket 78 of shroud 76 is configured to receive the flexible tines 74 of the female portion 52 of the connector while the center pin 64 is received into the socket 70 of the female connector portion 52. The embodiment illustrated in FIGS. 2A-4 includes a detent 80 that receives flared ends 82 of the flexible tines 74 that make up the jack 75 of the female portion 52 of the connector. The invention may be used with connectors using different detent systems, such as full detent, limited detent and smooth bore, with respective levels of engagement/disengagement forces. The invention thus may be used with various different push-on and snap-in mating styles.

The EMI shielding ring 50, as illustrated in FIG. 3, has an inner surface 100 defining an inner diameter D1. The shielding ring 50 also includes an outer surface 102 that defines an OD or outer diameter D2. The difference between the diameters defines a thickness of the ring. In accordance with one feature of the invention, the thickness and outer diameter of the EMI shielding ring 50 is optimized to create a high impedance cavity, as discussed herein, which will increase RF shielding performance of ring 50 by reflecting any escaping signal back to the connector and related circuit based on impedance changes of the transmission line. The thickness of the body also allows adjustment of the ring through flexure so that it maintains its grounding path even if slightly mis-aligned in the connector assembly. That is, the EMI ring 50 thickness and the slot 53 formed therein (see FIG. 3C) are optimized for proper mating force and durability, as well as to provide the outer conductor for a high impedance cavity which is optimized to reflect RF signals back to the assembly internal circuit. The body thickness of ring 50 also allows for flexure to help align the connector during mating as well as to provide more electrical contact with the mating shroud 76 even if slightly mis-mated. This feature of the ring of the invention is a departure from heavy bodies featured in the current prior art that have limited flexibility. In accordance with embodiments of the invention, the ring 50 has a thickness in the range of 0.004-0.008 inches with a slot having a width W in the range of 0.020-0.040 inches. The shielding ring body has a length in the range of 0.07 to 0.08 inches.

The EMI shielding ring 50 includes a proximal end 104 and a distal end 106 defined with respect to the female connector portion 52 and tines 74 over which the EMI shielding ring is seated. The thickness of the ring 50 is such that it is thin enough to allow easy insertion into the male shroud 76 with the female portion 52 as shown in FIG. 4.

In accordance with one feature of the invention, the EMI shielding ring includes a taper portion 110 at the distal end 106 of the EMI shielding ring 50. As illustrated in FIG. 3A in exploded view, the taper portion 110 is defined by a distal end tip radius 112, a taper section 114 and a distal end outer diameter radius 116. In one embodiment of the invention, the distal end tip radius 112 may have a radius in the range of 0.001-0.008. Similarly, the distal end outer diameter radius 116 may have a radius in the range of 0.010-0.030. The taper section 114 extends at an angle Θ in the range of 27-35 with respect to the longitudinal axis L for the connector 51 as illustrated in FIG. 3. The taper section 114 on the distal outer diameter has an optimized angle for electrical grounding to the mating shroud 76. The taper section is dimensioned and angled to be optimized to make electrical contact with a corresponding taper section 77 in the male shroud as shown in FIG. 4. The taper section 77 is generally consistent in all detents, and therefore the RF shielding performance using ring 50 is improved regardless of the mating detent. This allows RF shielding performance to be consistent throughout all detents in the different connector configurations. The distal end taper section 114 and distal end tip radius 112, as well as the proximal inner diameter lip 120 as discussed herein provide grounding which serve to shield stray signals from entering the internal circuit for optimal isolation performance.

As illustrated in FIG. 3B, the EMI shielding ring 50 also includes a lip 120 that is formed at the proximal end 104 of the ring. The lip 120 extends radially inwardly in the ring 50 toward the center or longitudinal axis L and includes an inner diameter radius 122. The lip 120 on the inner diameter of the proximal end 104 contacts the body or tines 74 of the female connector portion 52 to limit rocking of the female portion of the connector relative to the male portion 54. The proximal end lip 120 also contacts the seating plane 142 of the female connector portion 52 which provides electrical grounding and stability. The inner diameter radius 122 of the lip is in the range of 0.001-0.008.

The lip 120 also includes an outer diameter radius 124 at the proximal end 104. The proximal end lip has a radius 122 on the inner diameter and a radius 124 on the outer diameter of the lip to allow for easier installation, as well as increased electrical contact. The lip 120 has the radius 112 on the distal end 106 and the radius 122 on the proximal end 104 to allow better contact and smooth mating/de-mating of the connector portions 52, 54. The outer diameter radius 124 at the proximal end 104 may be in the range of 0.001-0.008. The proximal end lip 120 extends radially inwardly in the shielding ring 50 a distance of D as illustrated in FIG. 3B for engaging the tines 74 of the female portion 52. The distance D or length of the proximal lip may be in the range of 0.001-0.012 inches from the inner diameter or inner surface 100 of the ring 50. The proximal end lip 120 has a radius 122 to allow for easier installation, as well as increased electrical contact. The EMI ring has a proximal outer diameter radius 124 as well to allow the connectors to rotate relative to one another and allow for adjustment of the ring for optimum EMI shielding and anti-rock performance.

When the ring is seated in the connector 51 with female portion 52 seated in or pushed into the male portion socket 78, the lip 120 makes contact at the inner diameter 122 with the female portion 52 as illustrated in FIG. 4. Specifically, the lip 120 contacts the base 140 of the flexible tines 74 when the EMI shielding ring 50 is captured between the portions of the connector assembly. The lip 120 abuts against a shoulder 144 of the female portion 52 that defines a seating plane 142 for the mated connector portions 52, 54. The lip 120 contacts the female portion 52 of the connector and limits rocking of the female portion 52 relative to the male portion 54. The radius 124 formed on the proximal end 104 of the shielding ring and the radius 112 formed on the distal end 106 of the ring allow better contact as well as a smoother mating and de-mating between the female connector portion 52 and the male connector portion 54. Furthermore, those radii allow for rotation of the connector portions relative to each other when they are mated as illustrated in FIG. 4.

Referring to FIG. 3C, the ring 50 also has a slot 53 along its length L which allows it to compress for smooth mating/de-mating and to allow the distal end 106 to flex relative to the proximal end 104 which will aid axial alignment while maintaining electrical contact with the shroud 76. The slot may have a width W as mentioned.

Referring to FIG. 4, when the connector portions 52, 54 and the ring 50 are coupled together, the lip 120 contacts the tines 74 as shown in region 152 in FIG. 4 and the taper section 114 contacts the surface 77 of the shroud as shown in region 150 and always remains in contact regardless of alignment. This contact of the ring acts to re-align any misaligned connectors and provides an anti-rocking capability. The thickness of the ring 50 as shown in the seated position of FIG. 4 allows for flexing which provides a proper electrical grounding path even if the connector portions 52, 54 are slightly mis-mated. Contact between the taper section 114 and the detent surface 77 results in the maintenance of a high impedance choke cavity as shown in region 154 in FIG. 4. The type of detent is not significantly relevant using the ring 50 of the invention as the contact and choke cavity are maintained due to the taper section 114 of the EMI ring 50.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A connector comprising:

a male portion and a female portion configured for mating with the male portion;

the female portion including at least one flexible element;

a conductive shielding ring having a cylindrical body configured for surrounding the at least one flexible element of the female portion for providing a grounding path between the male and female portions of the connector when they are mated;

the shielding ring body having an inner surface and an outer surface and having a taper portion extending radially inwardly on a distal end of the shielding ring body for engaging a surface of the male portion;

the shielding ring body having a lip extending radially inwardly at the proximal end of the shielding ring for engaging the at least one flexible element of the female portion when the male and female portions of the connector are mated.

2. The connector of claim 1 further comprising a chamfered surface in the male portion, the taper portion of the shield ring configured for abutting the chamfered surface when the male portion and female portion are mated.

3. The connector of claim 1 wherein the lip is configured for engaging a base of the at least one flexible element for securing the female portion with the male portion when they are mated.

4. The connector of claim 1 wherein the lip extends radially inwardly on the shielding ring body and terminates in a radiused end, the radiused end of the lip configured for rotating on the at least one flexible element of the female portion for rotating the shielding ring.

5. The connector of claim 1 wherein the thickness between the inner surface and outer surface of the shielding ring body is in the range of 0.004 to 0.008 inches.

6. The connector of claim 1, wherein the body of the shield ring includes a slot formed therein for allowing compression of the body when the male and female portions of the connector are mated.

7. The connector of claim 1 wherein the shielding ring body has a length in the range of 0.07 to 0.08 inches.

8. The connector of claim 1 wherein the taper portion angles radially inwardly from at an angle from a longitudinal axis of the shielding ring body in the range of 27 to 35 degrees.

9. The connector of claim 1 wherein the taper portion includes a taper section on the outer surface of the shielding ring body and at least one radiused section proximate the taper section.

10. The connector of claim 9 wherein the at least one radiused section includes at least one of a tip radiused section at the distal end of the shielding ring body or an outer diameter radiused section proximate the distal end of the shielding ring body.

11. A shielding ring for providing a grounding path between opposing portions of a connector when the connector portions are mated, the shielding ring comprising:

a conductive body having an inner surface and an outer surface, the body inner surface configured for surrounding an outer surface of a flexible element of a first connector portion;

a taper portion extending radially inwardly on a distal end of the conductive body, the taper portion configured for engaging an inner surface of a second connector portion that surrounds the conductive body and the first connector portion when the connector portions are mated;

a lip extending radially inwardly at the proximal end of the of the conductive body for engaging the flexible element of the first connector portion of the connector when the connector portions are mated.

12. The shielding ring of claim 11 wherein the lip extends radially inwardly and terminates in a radiused end, the radiused end of the lip configured for rotating on a first connector portion for rotating the shield ring.

13. The shielding ring of claim 11 wherein the taper portion includes a taper section on the outer surface of the conductive body and at least one radiused section proximate the taper section.

14. The shielding ring of claim 11 wherein the at least one radiused section includes at least one of a tip radiused section at the distal end of the conductive body or an outer diameter radiused section proximate the distal end of the conductive body.

15. The shielding ring of claim 11 wherein the conductive body has a thickness between the inner surface and outer surface of the conductive body in the range of 0.004 to 0.008 inches.

16. The shielding ring of claim 11, wherein the conductive body includes a slot formed therein for allowing compression of the conductive body when the first and second connector portions are mated.

17. The shielding ring of claim 11 wherein the conductive body has a length in the range of 0.07 to 0.08 inches.

18. The shielding ring of claim 11 wherein the taper portion angles radially inwardly at an angle from a longitudinal axis of the body in the range of 27 to 35 degrees.

19. The shielding ring of claim 11 wherein the first connector portion is a female portion having flexible tines and the second connector portion is a male portion having a shroud to surround the flexible tines when the connector portions are mated, the taper portion configured for engaging an inner surface of the shroud and the lip configured for engaging the flexible tines.

20. The shielding ring of claim 19 wherein the taper portion is configured for abutting a chamfered surface in the shroud of the male portion.

* * * * *